US008371766B2

(12) United States Patent
Huang

(10) Patent No.: US 8,371,766 B2
(45) Date of Patent: Feb. 12, 2013

(54) PENPOINT-LIKE LIQUID DISTRIBUTOR

(76) Inventor: Tao-Chen Huang, Changhua County (TW)

( * ) Notice: Subject to any disclaimer, the term of this patent is extended or adjusted under 35 U.S.C. 154(b) by 261 days.

(21) Appl. No.: 13/016,128

(22) Filed: Jan. 28, 2011

(65) Prior Publication Data

US 2012/0195675 A1 Aug. 2, 2012

(51) Int. Cl.
*B43K 5/00* (2006.01)

(52) U.S. Cl. ..... 401/206; 401/205; 401/264

(58) Field of Classification Search ..... 401/205, 401/206, 263, 264
See application file for complete search history.

(56) References Cited

U.S. PATENT DOCUMENTS 6,599,046 B2 * 7/2003 Fukushima et al. ..... 401/206
6,817,802 B2 * 11/2004 Nishitani et al. ..... 401/235
7,086,799 B1 * 8/2006 Pappageorge et al. ..... 401/206
7,182,541 B1 * 2/2007 Ziniti et al. ..... 401/206

* cited by examiner

*Primary Examiner* — David Walczak
(74) *Attorney, Agent, or Firm* — WPAT, P.C.; Anthony King

(57) ABSTRACT

A penpoint-like liquid distributor to be installed onto a container includes a receiving element, a propping element, a positioning element, a pen tube and a pen tip. The propping element has a cone that is flexibly pushing against the pen tube and closely fitting the positioning element. In non-use, a feeding portion provided on the pen tube is isolated from the container; however, when a user applies a force to the pen tube, the pen tube retreats inward and pushes the cone away from the positioning element so as to intercommunicate the feeding portion with the container. Thus, a liquid cosmetic product contained in the container is allowed to flow out through and then discharge from the pen tube. Therefore, the pen tube will not be polluted or blocked by the liquid cosmetic product accidentally.

8 Claims, 5 Drawing Sheets

PENPOINT-LIKE LIQUID DISTRIBUTOR

BACKGROUND OF THE INVENTION

1. Technical Field

The present invention relates to liquid distributing apparatuses, and more particularly, to a penpoint-like liquid distributor to be mounted on a liquid container for distributing a liquid cosmetic product stored in the container in a smooth and controlled manner without overflowing, polluting or clogging the liquid distributor.

2. Description of Related Art

The conventional cosmetic containers such as a nail art pen may include a container for accommodating a liquid cosmetic product and a penpoint-like liquid distributor for delivering the liquid cosmetic product in a controlled manner. The existing penpoint-like liquid distributors include those headed with a fiber brush and those headed with a ball-point mechanism for distributing liquid cosmetics. When a container adopting any of said prior-art devices is unintentionally pressed by an external force, which is a case that often occurs in a lady's purse, the liquid cosmetic product it contains may be squeezed out and pollute the surrounding of the container. Furthermore, after the overflow is dried, the liquid distributor may be blocked and fail to provide further liquid distribution.

A cap is therefore provided for preventing such overflow and blockage. Nevertheless, for easily uncapping the liquid distributer, the firm combination between the cap and the liquid distributer is usually compromised. As a result, such a cap is likely to coming off and thus is inefficient for the intended purpose.

Besides, since the existing penpoint-like liquid distributors are mostly designed to provide a single, fixed stroke width, the painted stroke of liquid cosmetics is constant and lacks for change. For creating vivid painting, plural liquid distributors of different stroke width have to be prepared, thus increasing inconvenience and expense.

SUMMARY OF THE INVENTION

In view of the shortcomings of the prior-art devices, the present invention provides a penpoint-like liquid distributor to be installed to a container for distributing a liquid cosmetic product contained in the container with the attempt to improve liquid distribution.

For fulfilling the above goals, by referring to the drawings, the present invention involves a penpoint-like liquid distributor having at least a receiving element, a propping element, a positioning element, a pen tube and a pen tip.

The receiving element is a hollow pipe-like object and has a receiving space formed therein. The receiving element has one end formed with a connecting portion for mounting with the inner rim of an opening of a container and the other end opposite to the end terminated with a through hole, wherein at least one slot is provided on a wall of the receiving element surrounding the through hole for intercommunicating the receiving element with the inside of the container.

The propping element is in a shape approximate to a rod and is movably extendable and retreatable in the receiving space of the receiving element. The propping element is movably provided in the receiving element and has one end to be slidably penetrated into the through hole and the other end opposite to the end formed with a cone. Therein, a resilient element is disposed between the receiving element and the propping element.

The positioning element has an axial hole axially provided at its center, and the positioning element has one end formed with a mounting portion for movably engaging with the inner rim of the connecting portion and the other end opposite to the end provided with a plurality of non-closed flexible grooves.

The pen tube is a hollow tube having one end formed with a feeding portion and the other end opposite to the end formed with a pen nib. Therein, the feeding portion is flexibly pushed by the propping element.

The pen tip is a funnel-like cylinder having one end formed with a screwing portion that has a thread at inner side thereof for screwing with the outer rim of the opening of the container and for containing the receiving element and the positioning element therein. A passage is provided in the pen tip for allowing the pen tube to penetrate therethrough and exposing the pen nib outside.

The implementation of the present invention can achieve at least following objectives.

The primary objective of the present invention is to provide the feeding portion flexibly pushed by the resilient element and retreated inward the axial hole. When non-use or in storage, the feeding portion is not intercommunicating with the container so that preventing the liquid cosmetic product from flowing into the feeding portion. The cone is engaged with the axial hole and effectively preventing the liquid cosmetic product from flowing into the pen tube. Therefore, even when an external force acting on the container, the liquid cosmetic product will not overflow or spill accidentally, thus avoiding a pollution or waste of the liquid cosmetic product, or a blockage to the pen tube.

The present invention is to offer a solution to a user that when the pen nib is pressed against a surface to be worked, the pen tube is propped and pressed against the cone of the propping element, and then the pen tube and the propping element are retreated inward the axial hole, thereby intercommunicating the feeding portion of the pen tube and the container. At then, the feeding portion of the pen tube intercommunicates with the container thus allowing the liquid cosmetic product to flow into the pen tube and discharge from the pen nib.

Another object of the present invention is to provide the pen tube that is a hollow tube having the pen nib shaped as a cone and having more than one non-closed discharging grooves provided on the surface of the pen nib. Therefore, the pen tube is simple in structure and not easily blocked.

Another object of the present invention is to provide the penpoint-like liquid distributor combining the pen tube made of a plastic material with the cone design of the pen nib for preventing hurting the surface to be worked.

Another object of the present invention is to provide the container made of a plastic material, which is flexible and supple. The user can apply or paint with makeup products in diverse degrees of line that resulting in many stroke variants through the one-size pen tube by virtue of placing different magnitude of the strength on the container for controlling the flow of the liquid cosmetic product discharging from the pen tube and the design of the discharging grooves.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of an illustrative embodiment when read in conjunction with the accompanying drawings, wherein:

DETAILED DESCRIPTION OF THE PREFERRED EMBODIMENT

For the convenience of explaining the concept of subject matter in the present invention, herein a preferred embodiment is disclosed. It is noted that all objects contained in the embodiment are described in an appropriate ratio, scale, deformation or displacement quantities applicable to the scope of explanation purpose rather than the ratio of any actual elements of the present invention.

Figure 1:
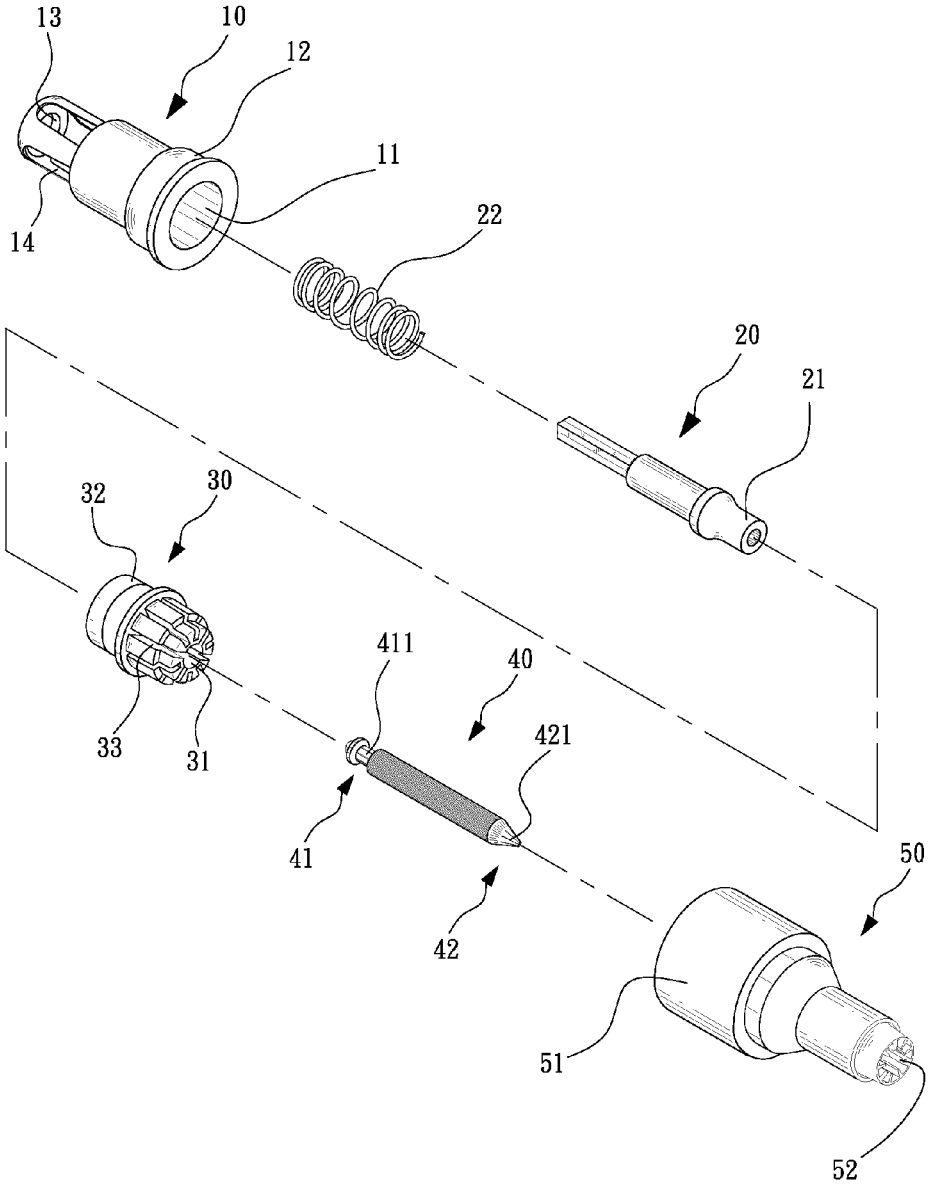
FIG. 1 is an exploded view of a penpoint-like liquid distributor according to the present invention.
Figure 2:
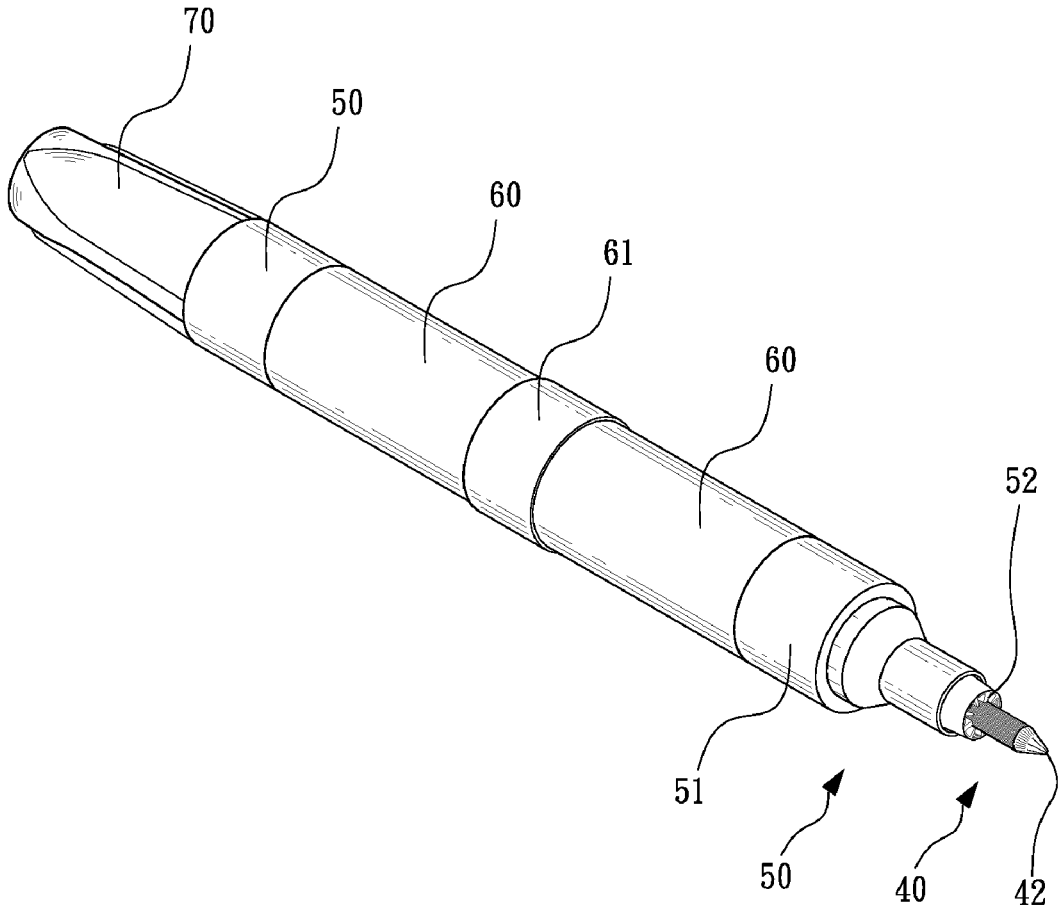
FIG. 2 is an applied view of the penpoint-like liquid distributor in the present invention when adopted by a dual-head painter.

The object of the present invention is to provide a penpoint-like liquid distributor applicable to most containers for liquid cosmetics. As for functions provided by said penpoint-like liquid distributor adopted in the containers are detailed in the following paragraphs by referring to accompanying drawings and preferred embodiments. As depicted in FIG. 1 and FIG. 2, according to the present invention, a penpoint-like liquid distributor applicable to a container for liquid cosmetics comprises a receiving element 10, a propping element 20, a positioning element 30, a pen tube 40 and a pen tip 50.

Figure 4:
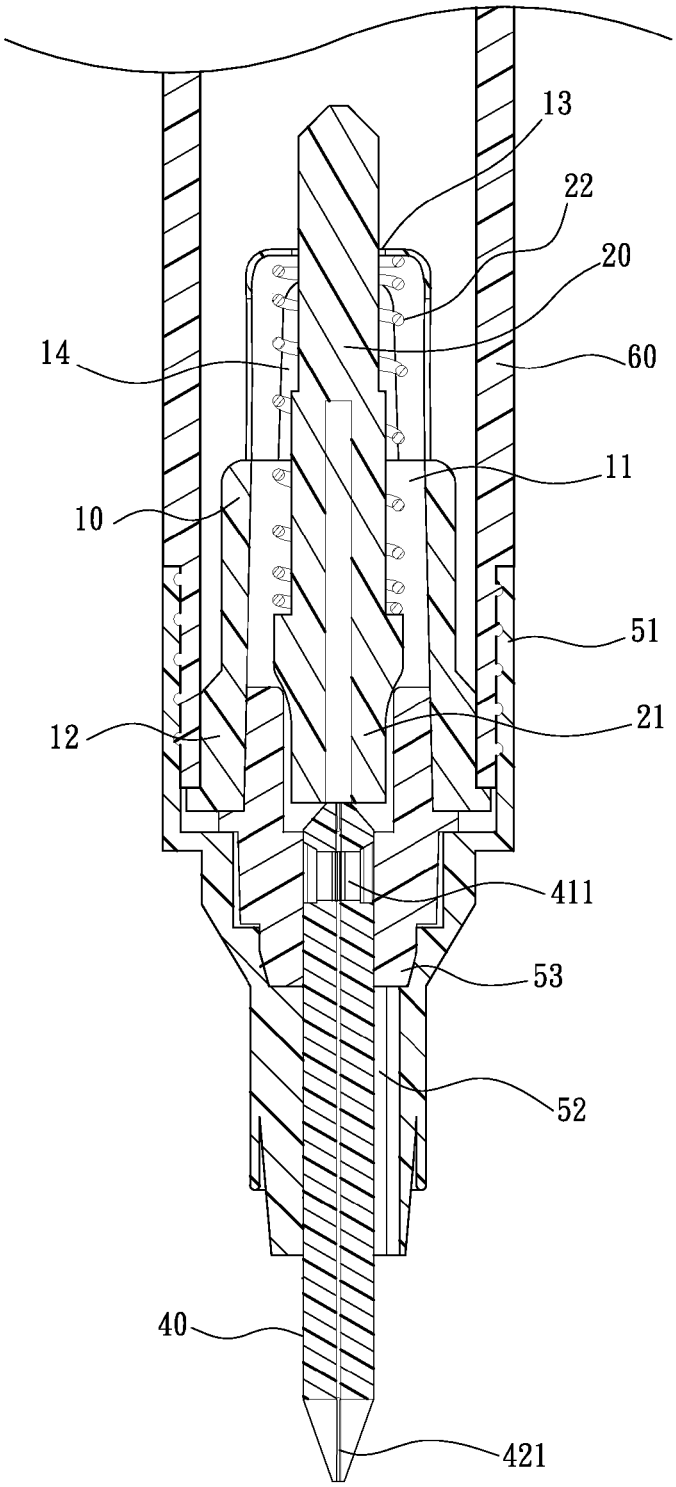
FIG. 4 is another cross-sectional view of the penpoint-like liquid distributor in the present invention showing that the penpoint-like liquid distributor is mounted with and closed at the painter.

The receiving element 10 is a hollow pipe-like object and has a receiving space 11 formed therein. The receiving element 10 has one end formed with a connecting portion 12 for combining with the inner rim of an opening of a container 60, as shown in FIG. 4, and the other end opposite to the end terminated with a through hole 13 wherein at least one slot 14 is provided on a wall of the receiving element 10 surrounding the through hole 13 for intercommunicating the receiving element 10 with the inside of the container 60.

The propping element 20 is in a shape approximate to a rod and is configured to extend or retreat in the receiving space 11 of the receiving element 10. The propping element 20 has one end slidably penetrated into the through hole 13 and the other end opposite to the end formed with a cone 21. Therein, a resilient element 22 such as a spring is sleeved around the propping element 20 and disposed between the receiving element 10 and the propping element 20, and the resilient element 22 has one end pressing against the cone 21 and the other end opposite to the end pressing against the wall of the receiving element 10 surrounding the through hole 13, so that the propping element 20 is allowed to flexibly extend or retreat in the receiving space 11.

The positioning element 30 has an axial hole 31 axially provided at its center, and the positioning element 30 has one end formed with a mounting portion 32 for movably engaging with the inner rim of the connecting portion 12 and the other end opposite to the end provided with a plurality of non-closed flexible grooves 33, wherein the axial hole 31 has an opening formed atop the flexible grooves 33. The positioning element 30 is dented with an arc recess axially aligned with the opening for matching up with the cone 21.

The pen tube 40 is a hollow tube having one end that is received in the axial hole 31 of the positioning element 30 and formed with a feeding portion 41, and the other end opposite to the end formed with a pen nib 42. Therein, the feeding portion 41 has a plurality of feeding holes 411 for intercommunicating the container 60 with the pen tube 40, while the pen nib 42 is shaped as a cone and has more than one non-closed discharging grooves 421 on the surface thereof for intercommunicating the pen tube 40 with the pen nib 42, thus allowing the liquid cosmetic product in the container 60 to flow through the pen tube 40 and then get into the pen nib 42.

The pen tip 50 is a funnel-like cylinder having one end formed with a screwing portion 51 that has threads at inner side thereof for screwing with the outer rim of the opening of the container 60 and for containing the receiving element 10 and the positioning element 30 therein. A passage 52 is provided in the pen tip 50 for allowing the pen tube 40 to penetrate therethrough and thereby exposing the pen nib 42. The pen tip 50 has the other end opposite to the end formed with a fixing portion 53 facing the positioning element 30 and being gradually contracted in its diameter toward the passage 52 as shown in FIG. 4. The pen tip 50 is covered by a cap 70 as shown in FIG. 2, wherein the cap 70 is made of a soft and supple material, such as elastomer, to be contacted with the pen tube 40 so as to close the pen tube 40 and the cap 70 in an airtight manner.

Basing on the structure given above, the operation of the present invention and the principles on which the operation is established are explained in detail below.

FIG. 2 is an applied view of the penpoint-like liquid distributor in the present invention when adopted by a dual-head painter. The painter consists of two containers 60 and two penpoint-like liquid distributors respectively provided at two opposite ends thereof. The two containers 60 are capable of connecting with each other by virtue of a retaining ring 61 or other fastening means, thus allowing a user to handle various cosmetic products in a single grasp. Each of the penpoint-like liquid distributors is protected by a cap 70.

Figure 3:
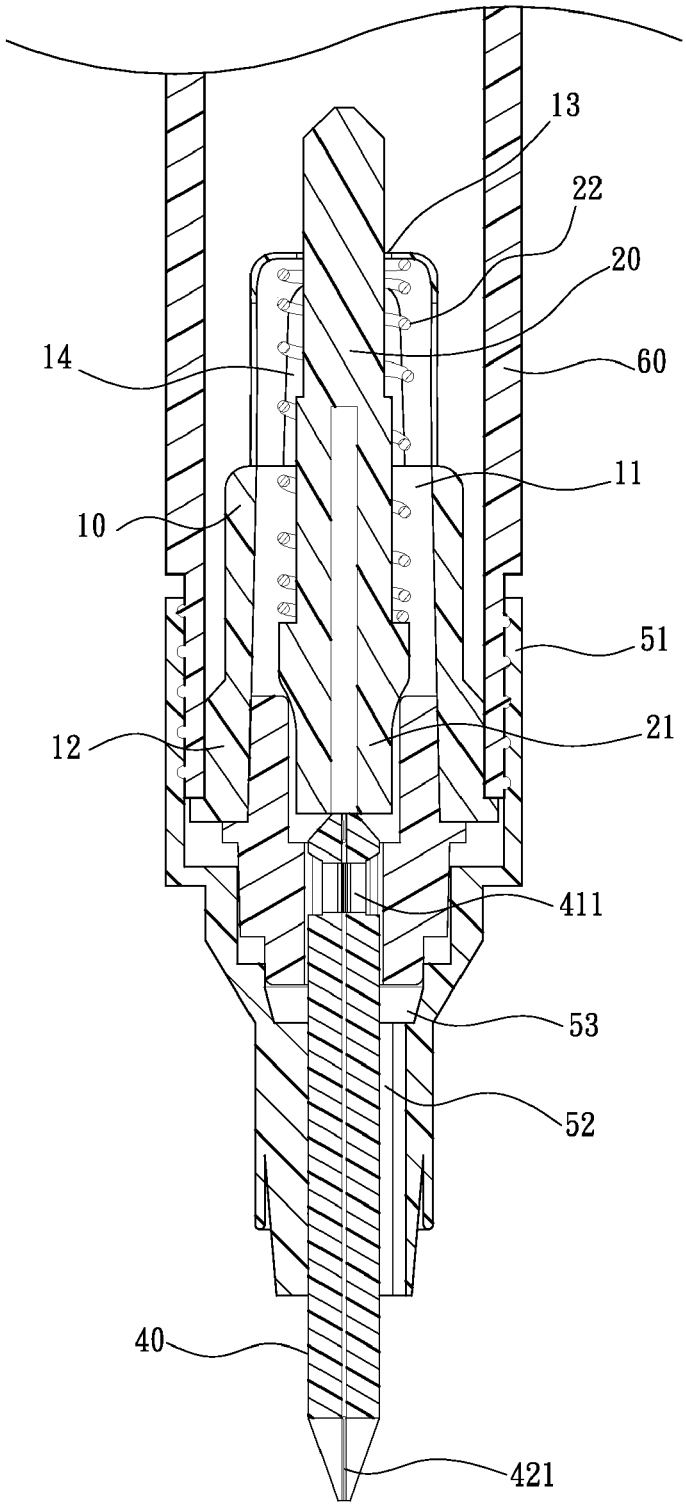
FIG. 3 is a cross-sectional view of the penpoint-like liquid distributor in the present invention showing that the penpoint-like liquid distributor is to be mounted onto the painter.

As indicated in FIG. 3, to fabricate the penpoint-like liquid distributor, the receiving element 10, the propping element 20, the positioning element 30 and the pen tube 40 are assembled in order, and then the assembly is combined with the inner rim of the opening of the container 60. Afterward, the pen tip 50 is secured within the container 60 through the screwing portion 51. When the screwing portion 51 is screwed onto the container 60, the fixing portion 53 having the tapered structure is gradually pressing toward the axial hole 31 of the positioning element 30. In the meantime, the axial hole 31 is gradually compressed and contracted in virtue of the flexible grooves 33 and then placing a flexible retaining force, as depicted in FIG. 5, to the pen tube 40 to such an extent that the pen tube 40 is driven to slide inward, thus avoiding the pen tube 40 from loosing off.

As presented in FIG. 4, the cone 21 has its diameter gradually enlarged from the axial hole 31 toward the through hole 13. The cone 21 is, at where its smallest diameter is, smaller than the diameter of the axial hole 31, and is, at where its greatest diameter is, larger than the diameter of the axial hole 31. On the strength of the resilient element 22, the cone 21 closely fits an opening of the axial hole 31 at the mounting portion 32 while the feeding portion 41 of the pen tube 40 is pushed by the resilient element 22 and retreated inward the axial hole 31, thereby not intercommunicating the pen tube 40 and the container 60. Thus, in non-use or in storage, the feeding portion 41 of the pen tube 40 is not intercommunicating with the container 60 so as to prevent the liquid cosmetic product from flowing into the feeding portion 41. Even in case of an external force applied to the container 60, the liquid cosmetic product will not overflow or spill accidentally, thus avoiding a pollution or waste of the liquid cosmetic product, or a blockage to the pen tube 40.

Figure 5:
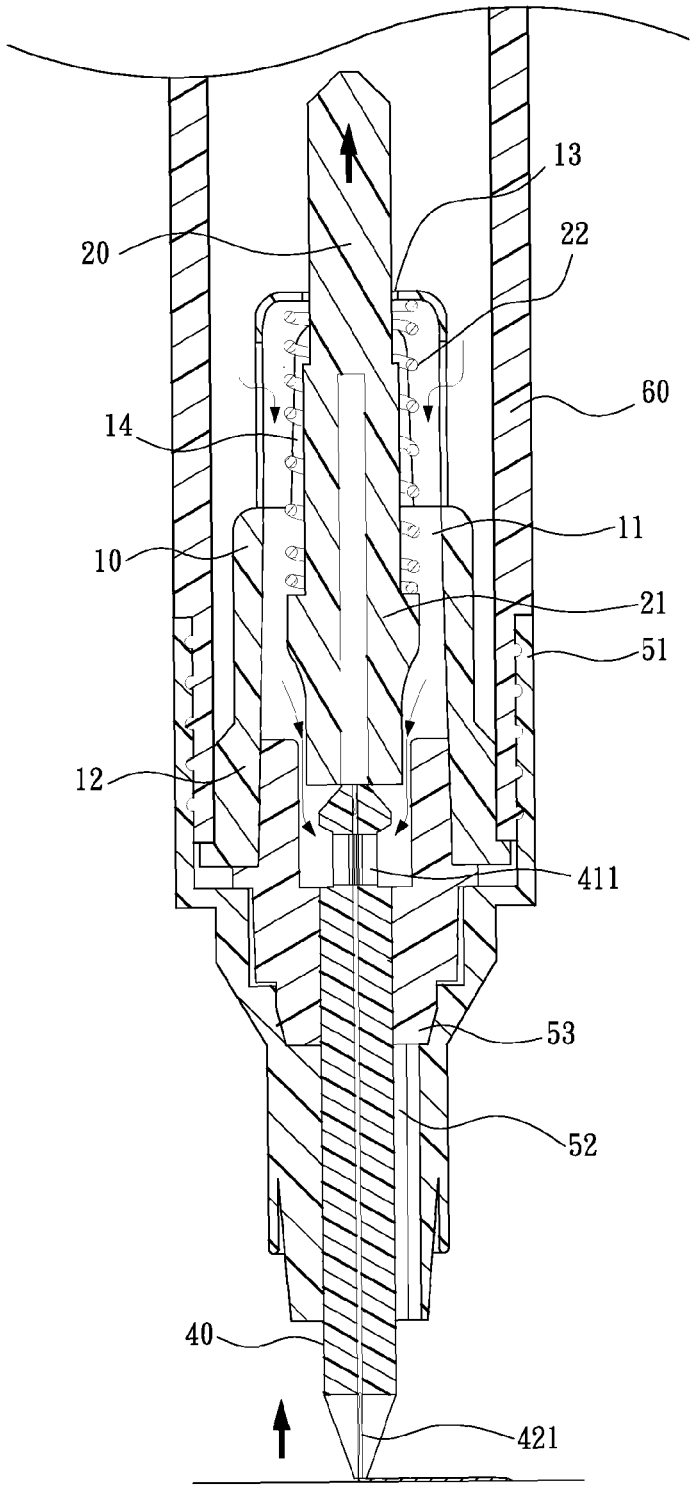
FIG. 5 is a cross-sectional view of the penpoint-like liquid distributor in the present invention showing a motion explaining how the liquid cosmetic product flows into the painter.

By referring to FIG. 5, when utilizing the painter employing the disclosed penpoint-like liquid distributor, the user holds the painter or the container 60 and contacts the pen nib 42 to a surface to be painted, so that a force is applied to the pen tube 40 to push forward the cone 21 of the propping element 20. The pen tube 40 and the propping element 20 are pushed and flexibly retreated inward so as to allow the feeding portion 41 to intercommunicate with the container 60 and in turn allow the liquid cosmetic product to flow out from the container 60, pass through the feeding holes 411, and then get into the pen tube 40 so as to be discharged from the discharging grooves 421 and applied to the surface.

As described above, the pen tube 40 is a hollow tube having the pen nib 42 shaped as a cone and the discharging grooves 421 on the surface of the pen nib 42 for intercommunicating the pen tube 40 with the pen nib 42, thus preventing the liquid cosmetic product from blocking the pen tube 40. Furthermore, in combination of the pen tube 40 which is in simple structure and made of a plastic material with the cone design of the pen nib 42, the painter is allowed to have a direct contact with the user's skin for applying or painting cosmetic products without hurting the skin.

In addition, the container 60 is usually made of a plastic material, which is flexible and supple. The user can apply or paint with cosmetic products in diverse widthes of line that resulting in many stroke variants through the one-size pen tube 40 by virtue of placing different magnitude of the strength on the container 60 for controlling the flow of the liquid cosmetic product discharging from the pen tube 40 and the design of the discharging grooves 421.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention rather than limit the scope of the present invention. Accordingly, the foregoing description and drawings are by way of example only.

What is claimed is:

1. A penpoint-like liquid distributor configured to be installed onto a container for distributing a liquid cosmetic product contained in the container, the liquid distributor comprising:

a receiving element that is a hollow pipe-like object having:

a receiving space formed therein;

a connecting portion formed at one end of the receiving element for combining with an inner rim of an opening of the container; and a through hole provided on an end opposite to the end of the receiving element, wherein at least one slot is provided on a wall of the receiving element surrounding the through hole for intercommunicating the receiving element with the container;

a propping element that is configured to extend or retreat within the receiving space of the receiving element and has:

one end being configured to be slidably penetrated into the through hole;

an opposite end formed with a cone; and a resilient element disposed between the receiving element and the propping element;

a positioning element having:

an axial hole axially provided at a center thereof;

a mounting portion for movably engaging with an inner rim of the connecting portion formed at one end thereof; and a plurality of non-closed flexible grooves provided on an opposite end of the positioning element;

a pen tube that is a hollow tube and has:

a feeding portion at one end thereof for being flexibly pushed by the resilient element; and a pen nib formed at an opposite end of the pen tube; and a pen tip having:

one end formed with a screwing portion for screwing with an outer rim of the opening of the container and for containing the receiving element and the positioning element therein; and a passage provided in the pen tip for allowing the pen tube to penetrate therethrough and exposing the pen nib.

2. The penpoint-like liquid distributor of claim 1, wherein the resilient element is a spring sleeved around the propping element.

3. The penpoint-like liquid distributor of claim 1, wherein the cone has a diameter gradually enlarged from the axial hole toward the through hole, and the cone is, at where a smallest diameter of the cone is, smaller than a diameter of the axial hole while the cone is, at where a greatest diameter of the cone is, larger than the diameter of the axial hole.

4. The penpoint-like liquid distributor of claim 3, wherein the cone is propped by the resilient element and engaging with the axial hole.

5. The penpoint-like liquid distributor of claim 1, wherein the feeding portion has a plurality of feeding holes for intercommunicating the container with the pen tube.

6. The penpoint-like liquid distributor of claim 1, wherein the pen nib has more than one non-closed discharging groove for intercommunicating the pen nib with the pen tube.

7. The penpoint-like liquid distributor of claim 1, wherein the pen tip has one end formed with the screwing portion while an opposite end formed with a fixing portion facing the positioning element and being tapered toward the passage.

8. The penpoint-like liquid distributor of claim 1, wherein the pen tip is covered by a cap in an airtight manner.

* * * * *